United States Patent [19]

Labbe

[11] Patent Number: 4,624,267

[45] Date of Patent: Nov. 25, 1986

[54] CIGARETTE MANUFACTURE

[75] Inventor: Francis A. Labbe, Paris, France

[73] Assignee: Molins PLC, London, England

[21] Appl. No.: 735,263

[22] Filed: May 17, 1985

Related U.S. Application Data

[62] Division of Ser. No. 453,900, Dec. 15, 1982.

[30] Foreign Application Priority Data

Apr. 16, 1981 [GB] United Kingdom ..... 8112090

[51] Int. Cl.[4] ..... A24C 5/39

[52] U.S. Cl. ..... 131/108; 131/109.1; 131/110

[58] Field of Search ..... 131/108, 109.1, 109.2, 131/109.3, 110

[56] References Cited

U.S. PATENT DOCUMENTS 4,095,604 6/1978 Labbe ..... 131/109.1

4,446,876 5/1984 Brackman ..... 131/109.2

*Primary Examiner*—V. Millin

*Attorney, Agent, or Firm*—Antonelli, Terry & Wands

[57] ABSTRACT

Apparatus for feeding tobacco pneumatically into a cigarette making machine has a duct defined on one side by a wall whose width (i.e. in cross-section) increases along the length of the duct from an inlet end to an outlet end, is concave in longitudinal section so that centrifugal force on the tobacco will urge the tobacco against that wall of the duct, and carries a splitter member arranged to split the tobacco stream flowing along the said wall into separate streams passing along opposite sides of the splitter member, and to spread apart the two streams. From the outlet end of the duct, the air and tobacco pass into an air separator from which the tobacco passes via a rotary seal into the hopper of a cigarette making machine. The rotary seal may have special provision for preventing tobacco being trapped and crushed between the rotary part and the surrounding housing of the seal.

11 Claims, 12 Drawing Figures

Fig. 6
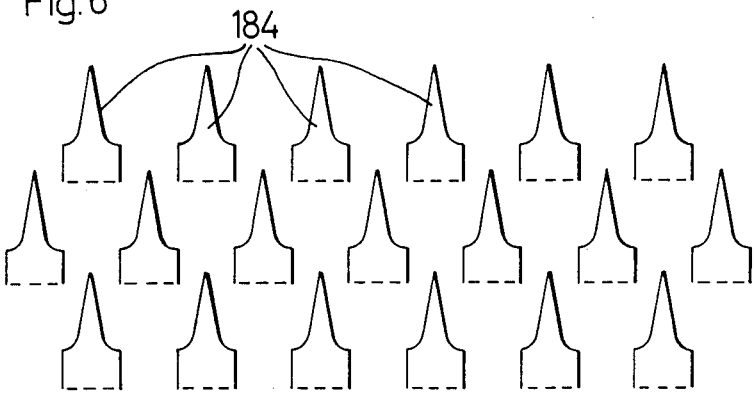
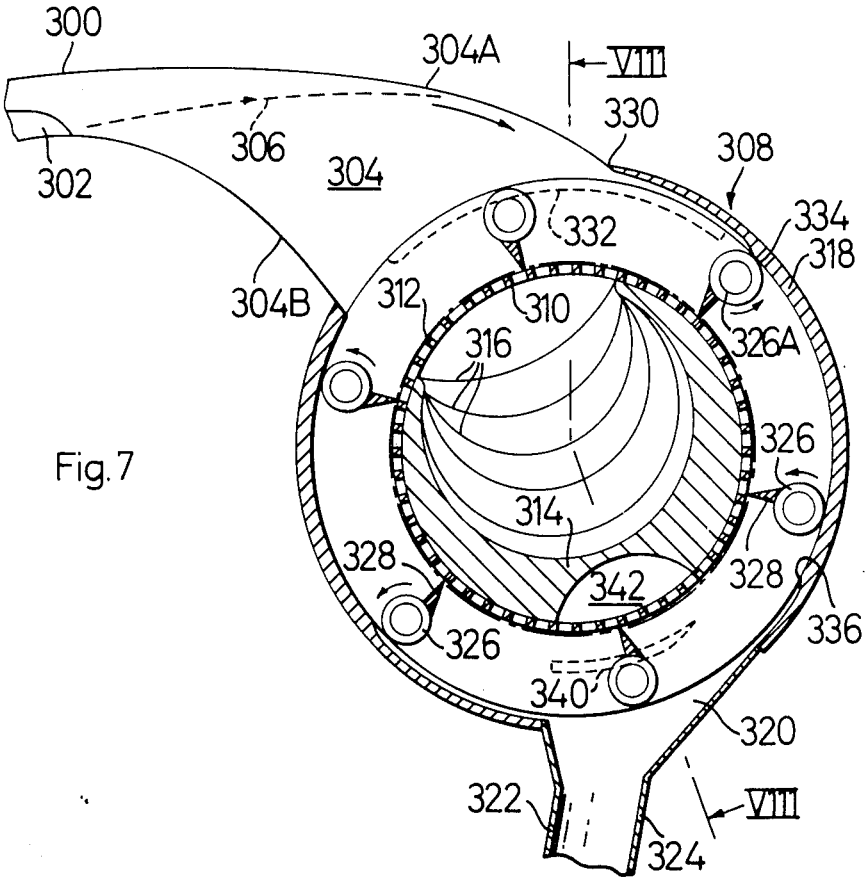
Fig. 7

Fig. 8
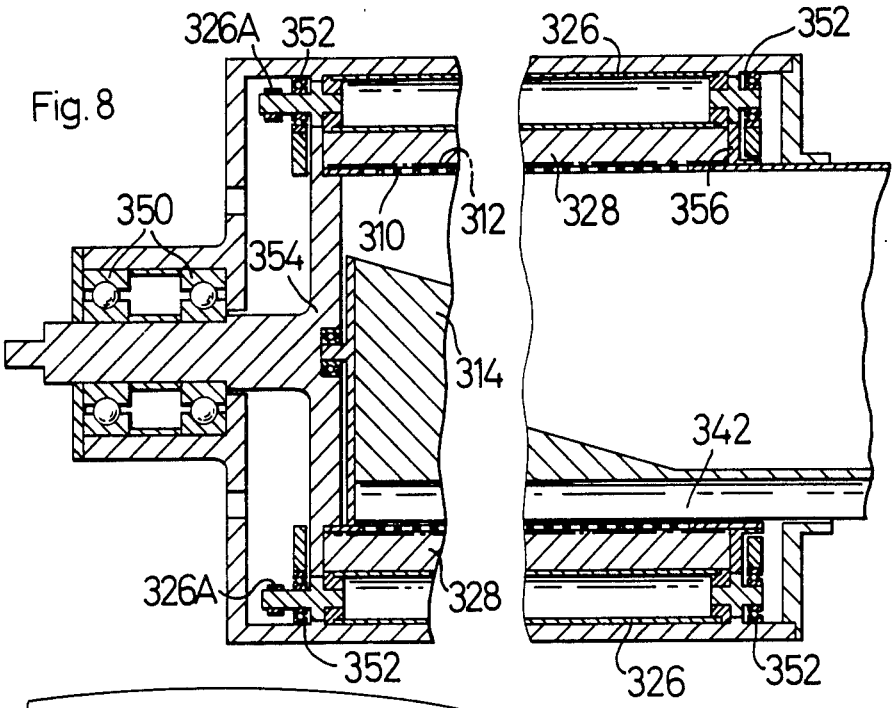
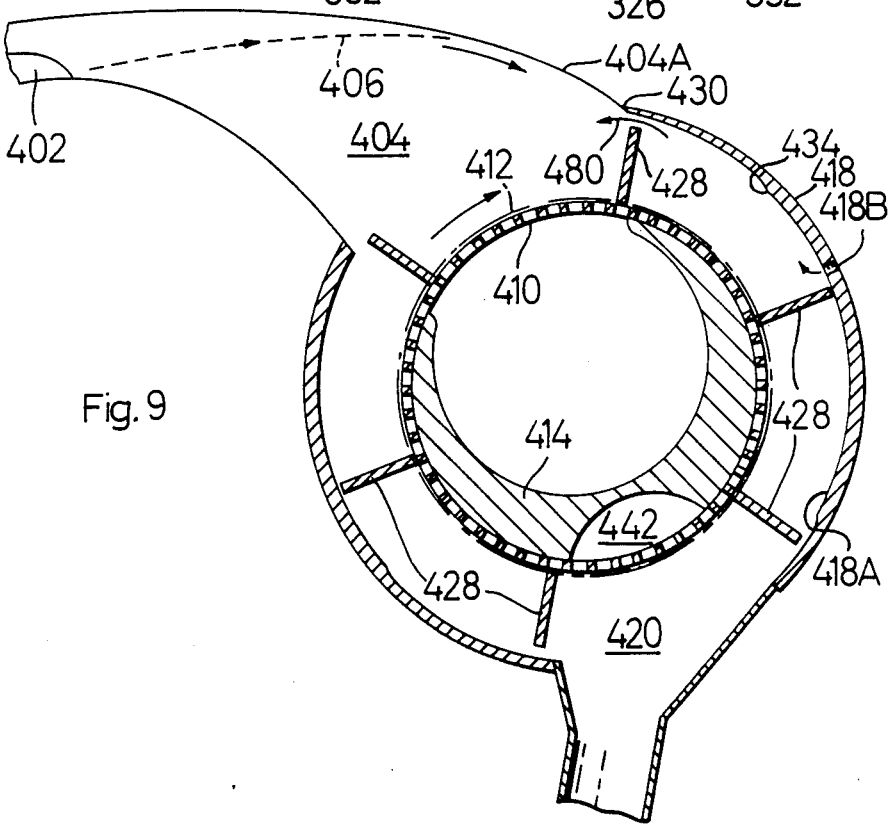
Fig. 9

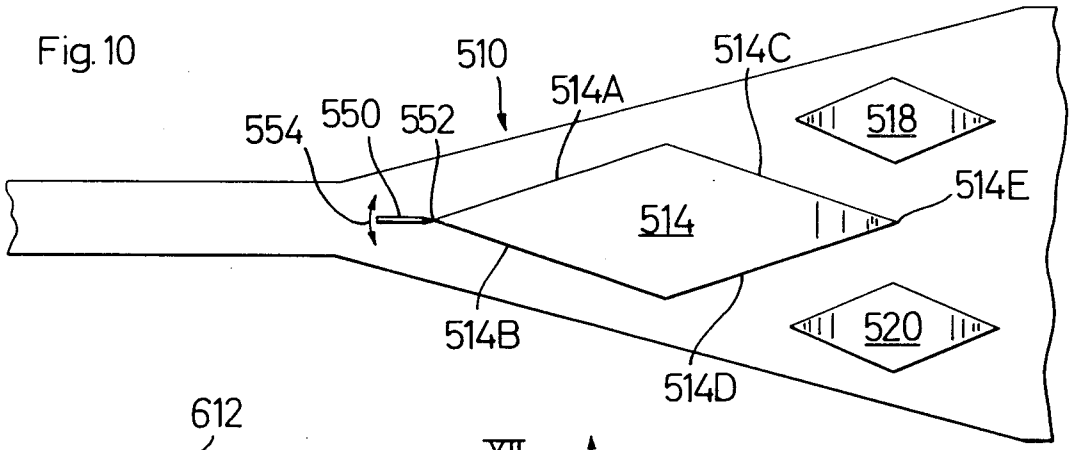
Fig.10
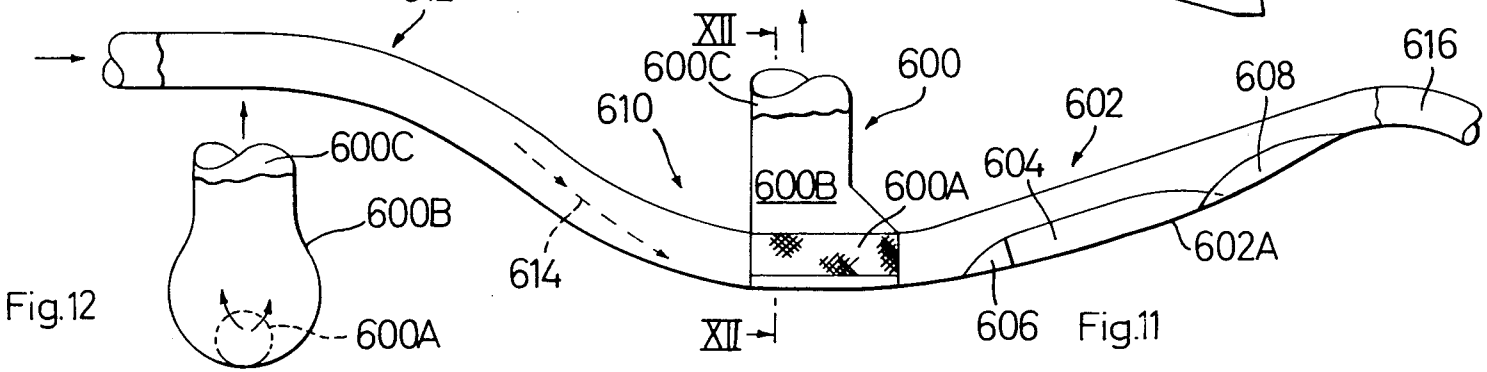
Fig.11
Fig.12

CIGARETTE MANUFACTURE

This is a division of application Ser. No. 453,900 filed Dec. 15, 1982.

Cigarette manufacture commonly involves the delivery of predetermined quantities of tobacco at substantially regular intervals into a tobacco storage space in a hopper of a cigarette making machine from which a metered carpet of tobacco is fed continuously to form a cigarette filler stream. The term "carpet" in this context refers to a wide fleece or stream of tobacco which is very much wider than the cigarette filler stream, each portion of which is commonly formed from tobacco derived from various positions across the width of the carpet, so that there is an averaging effect tending to produce a substantially uniform cigarette filler stream. For example, the carpet is commonly fed continuously into a channel through which the tobacco is showered (e.g. upwards with the aid of an air stream) onto a conveyor on which the filler stream is formed and is carried by suction. Examples of such cigarette making machines are the Molins' Mark 8 and Mark 9 machines. A hopper of a type commonly used in such machines is shown in British Patent Specification No. 909,222; British Patent Specification No. 916,141 shows in principle how a cigarette filler stream is formed from tobacco fed from the hopper.

This invention is concerned with feeding tobacco substantially continuously into the hopper of a cigarette making machine, thus avoiding the need for the hopper to store a large quantity of tobacco. Prior proposals in this connection are described in our British Patent Specifications Nos. 1,192,177 and 1,456,498.

According to one aspect of the present invention, apparatus for feeding tobacco pneumatically into a cigarette making machine comprises a duct defined on one side by a wall which increases in width (i.e. in cross-section) along the length of the duct from an inlet end to an outlet end, is concave in longitudinal section so that centrifugal force on the tobacco will urge the tobacco against that wall of the duct, and carries a splitter member arranged to split the tobacco stream flowing along the said wall into separate streams passing along opposite sides of the splitter member, and to spread apart the two streams. The splitter member preferably extends, from the wall carrying it, only part of the way towards the opposite wall of the duct, thus allowing a substantially unrestricted flow passage for air in the duct across part of the thickness of the duct.

The air transporting the tobacco through the duct is preferably separated from the tobacco by means of an air separator downstream of the duct. Alternatively, the air (or most of it) may be separated before the tobacco enters the duct, the tobacco being carried through the duct mainly or entirely by its forward momentum.

The splitter member may be followed by two further splitter members carried by the same wall of the duct and arranged to split each of the two separate streams to produce four separate streams. Further splitter members may be provided if desired.

The wall of the duct carrying the splitter member or members is preferably a lower wall of the duct. Thus gravity assists in urging the tobacco onto it.

Because of the splitting and spreading of the tobacco stream, apparatus according to this invention can be used to feed tobacco from a relatively narrow pipe (e.g. of round cross-section) into a channel having a width considerably greater than its thickness (both measured transversely to the direction of movement of the tobacco through the channel). The width of the channel may correspond approximately to the width of the carpet to be formed from the tobacco delivered from the channel.

In the case of a cigarette making machine producing discard tobacco (e.g. tobacco removed from the cigarette filler stream by a trimmer), the discard tobacco may be fed pneumatically into the duct via an opening in the wall carrying the splitter member or members, preferably in the following manner. At a position along the duct where centrifugal force has already caused the tobacco stream in the duct to pass along the wall carrying the splitter member or members, the discard tobacco is introduced through a secondary duct whose cross-section reduces towards the junction with the main duct and whose width increases (in the same sense as the wall of the main duct) so that the air from the secondary duct tends to move partly along diverging streams as it approaches the aperture in the wall of the main duct, which aperture is just upstream of the splitter member (or the first in the case of a plurality) so that the diverging air streams from the secondary duct tend to spread the tobacco in the main duct as it approaches the splitter member.

As already mentioned, after the tobacco in the duct has been split into a number of separate streams, the air (or most of it) may be separated from the tobacco while the tobacco proceeds into an appropriate channel in the hopper of the cigarette making machine. For that purpose, the air and tobacco delivered by the duct preferably enter an air separator having separate outlets for tobacco and air. The air outlet communicates with a suction fan whereby the air flow through the pipe and duct is induced. Thus there is suction pressure in the air separator, and the tobacco outlet from the separator should prevent any significant inflow of air from the atmosphere. One way of providing, in effect, an air seal in the tobacco outlet (e.g. British Pat. No. 1,192,177) involves forming a column of tobacco long enough to prevent any significant flow of air through it from the atmosphere; however, if a relatively high suction pressure is needed in the air separator in order to convey the tobacco penumatically through a long distance, a tobacco column seal of appropriate length might be impractical, in which case a rotary seal may be used.

A second aspect of this invention is concerned with an improved rotary seal for that purpose.

According to that second aspect of this invention, a rotary seal comprises a rotary member surrounded by a coaxial cylindrical housing having spaced openings for respectively receiving and discharging tobacco, the rotary member comprising a centre body carrying a number of circumferentially spaced projections extending to the housing and forming air seals while conveying tobacco from the inlet opening to the outlet opening of the housing, and including means for directing back towards the housing inlet (or in the opposite direction) any tobacco which might otherwise be trapped between each projection and the housing as the projection moves past the inlet. The said means may comprise a roller forming the extremity of each projection and rotating close to the housing in a direction such as to produce the desired effect. Alternatively, this may be achieved pneumatically by producing a small flow of air across the extremity of each projection as it leaves the inlet.

Another aspect of this invention is concerned with a hopper for a cigarette making machine suitable in particular for exploiting a continuous pneumatic feed according to the first aspect of this invention.

Examples of apparatus according to this invention are shown diagrammatically in the accompanying drawings. In these drawings:

FIG. 6 is a flat developed view of the spikes on the largest drum in FIG. 5;

FIG. 7 is a sectional end view of a different rotary seal;

FIG. 8 is a longitudinal section of the rotary seal shown in FIG. 7, approximately along line VIII—VIII in FIG. 7;

FIG. 9 is a sectional end view of another rotary seal;

FIG. 10 illustrates a modification of the splitter arrangement shown in FIG. 2;

FIG. 11 shows another modification, in which air is extracted upstream of the splitters; and FIG. 12 is a section on the line XII—XII in FIG. 11.

Figure 1:
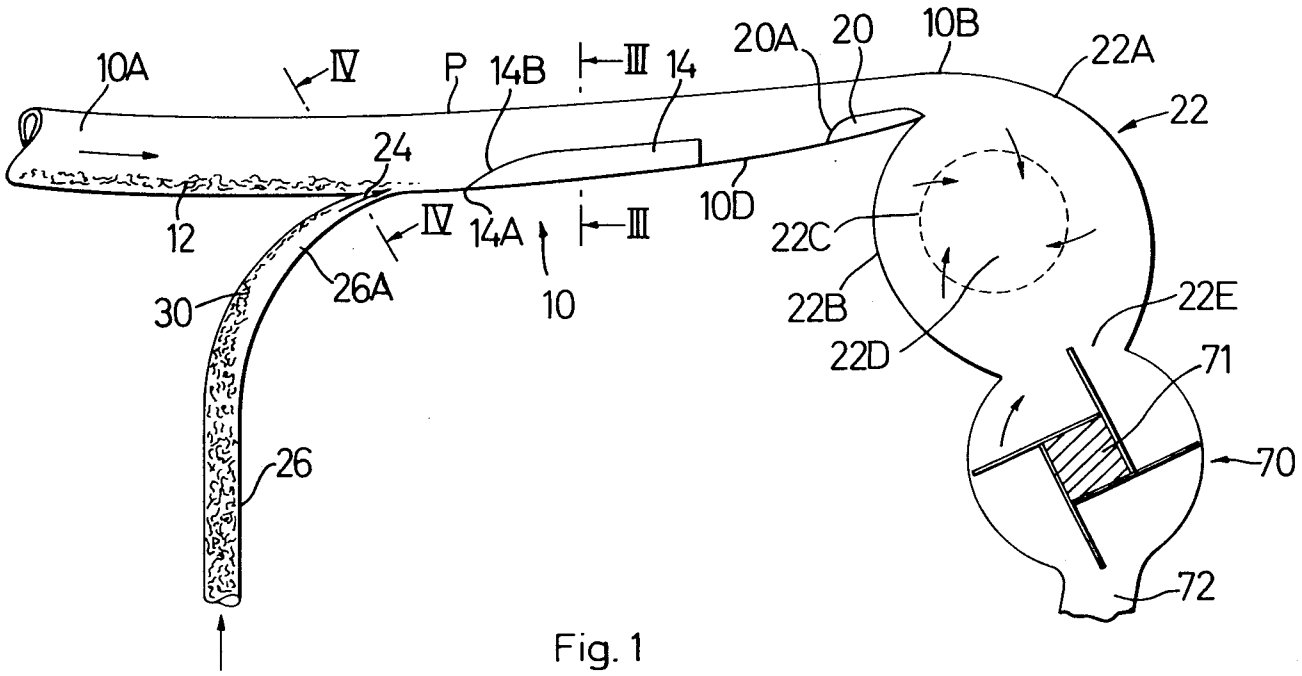
FIG. 1 is a side elevation of one apparatus.

FIG. 1 shows a duct 10 having an inlet end 10A and an outlet end 10B. At its inlet end the duct is of circular cross-section so as to be suitable for connecting to a pipe of similar diameter which will be used to deliver tobacco pneumatically from any suitable form of tobacco distribution system which may, for example, supply tobacco to a number of cigarette making machines each having an associated apparatus like that shown in FIG. 1.

Figure 2:
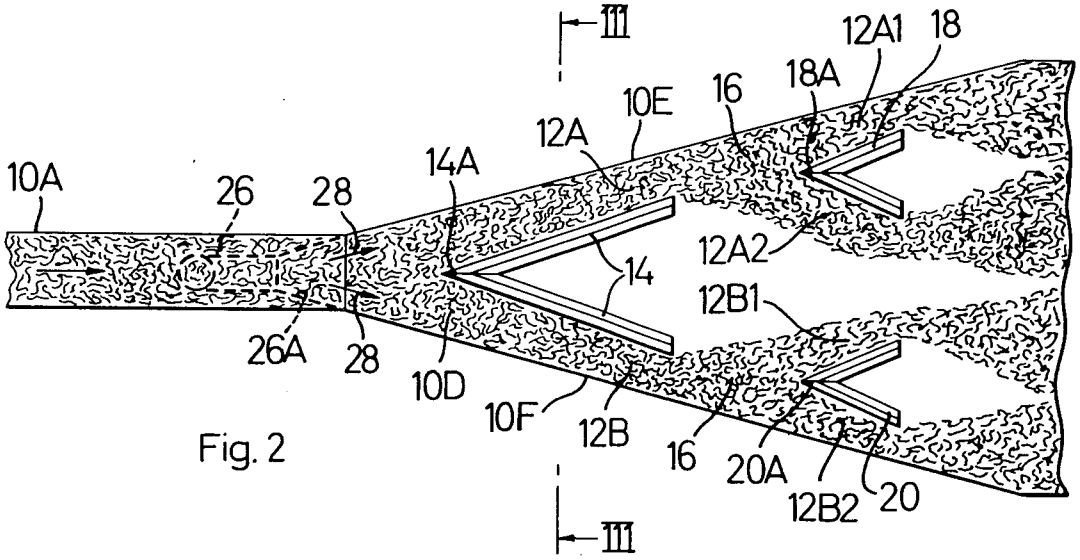
FIG. 2 is a plan view of the apparatus shown in FIG. 1, with the upper wall of the duct removed.
Figure 4:
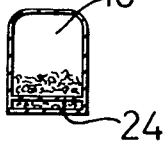
FIG. 4 is a section on the line IV—IV in FIG. 1.
Figure 3:
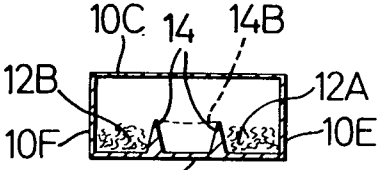
FIG. 3 is a section on the line III—III in FIG. 1.

Between its inlet end and the section line IV—IV, the cross-sectional shape of the duct changes progressively from a circular shape to a rectangular shape. Downstream of the section line IV—IV, the width of the duct increases progressively (see FIG. 2) while its vertical thickness reduces towards the outlet end of the duct. As shown in FIG. 3, upper and lower walls 10C and 10D of the duct are horizontal, being parallel to one another in cross-section, and are connected by vertical side walls 10E and 10F which diverge along the duct, as shown in FIG. 2.

The lower wall 10D of the duct is concave in longitudinal section, as shown in FIG. 1, the concave shape beginning at or even prior to the inlet 10A and continuing to the outlet 10B. As a result, tobacco carried pneumatically in the duct is urged downwards onto the lower wall 10D by centrifugal force and gravity.

The lower wall 10D of the duct carries a splitter member formed by two diverging strips 14 of triangular cross-section (see FIG. 3). Near the leading edge 14A of the splitter member there is a chamfered portion 14B as shown in FIG. 1. As a result of the splitter member, the tobacco stream 12 is split into two portions 12A and 12B which are progressively spread apart. Each stream 12A and 12B is progressively reduced in width and is increased in thickness by the action of the splitter member, but after passing the splitter member 14 is free to spread under the influence of centrifugal force (at regions 16) so as to arrive at further splitter members 18 and 20 as positions such that the leading edges 18A and 20A of the further splitter members substantially bisect the spread tobacco streams 12A and 12B, thus forming four substantially equal streams 12A1, 12A2, 12B1 and 12B2. Each of these four streams is then projected from the lower wall 10D of the duct and onto a curved wall 22A of an air separator 22, and in the process each of the four streams spreads slightly (as shown somewhat diagrammatically in FIG. 2) so that the gaps between the four streams become small. The spreading may continue along the wall 22A, which may progressively increase in width.

The air separator comprises, in addition to the wall 22A, a cylindrical casing 22B and a cylindrical mesh 22C through which air can pass into an outlet 22D leading to a suction fan (not shown). In addition, the air separator has a tobacco outlet 22E through which the tobacco may pass with substantially no air.

Figure 5:
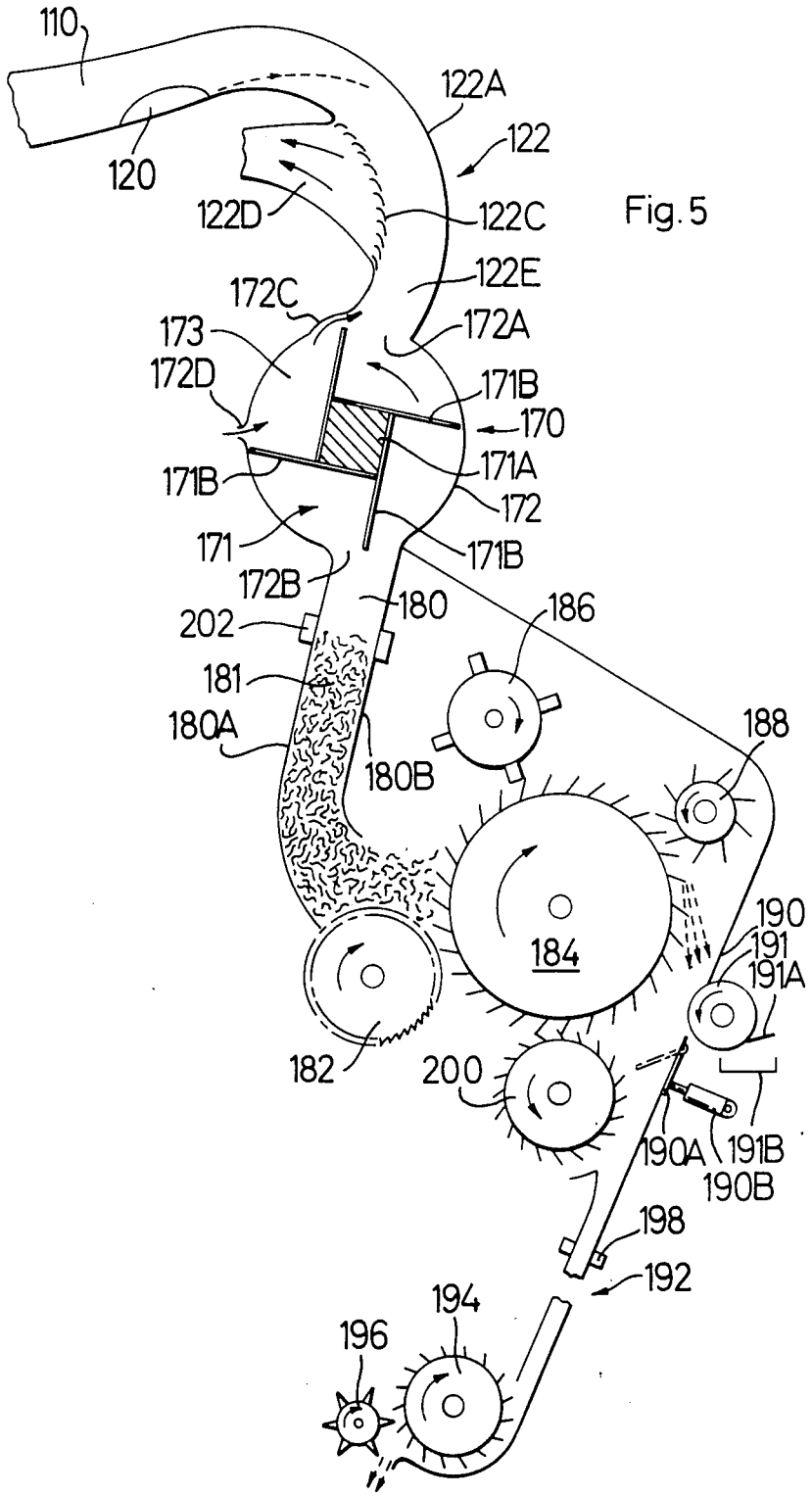
FIG. 5 is an elevation of part of a different apparatus, including a rotary seal and part of the hopper of a cigarette making machine.

Tobacco leaving the outlet 22E from the air separator enters a rotary seal 70 including a rotary member 71 which conveys the tobacco to an outlet 72 (which might form the inlet to a channel like the channel 180 in FIG. 5). The rotary member prevents any upward flow of air from the atmosphere through the outlet 22E of the air separator. Alternatively, the rotary seal may be in the form shown in FIG. 5, FIGS. 7 and 8 or FIG. 9.

At the upstream end of the concave lower wall 10D of the duct, there is an inlet 24 through which discard tobacco is delivered from a secondary duct 26. An end portion 26A of the duct 26 adjacent to the inlet 24 reduces progressively in thickness (as viewed in FIG. 1) while increasing progressively in width (see FIG. 2). The cross-sectional area of the inlet 24 is small enough to serve as a restriction limiting the flow of air from the secondary duct 26 into the main duct 10. That is desirable in one particular application of this invention in which the duct 26 communicates with a discard collection chamber in which there is a relatively low level of suction in comparison with the relatively high suction existing in the duct 10. Moreover, the effect of the end portion 26A of the duct 26 is to introduce the air from the duct 26 at a relatively high velocity with diverging air streams 28 (see FIG. 2) which help to spread apart the opposite sides of the tobacco stream 12 and facilitate splitting of the stream 12 by the splitter member 14. Similarly, the stream of discard tobacco 30, which is urged by centrifugal force against the concave left-side wall of the duct 26 (before the air velocity begins to increase in the reducing cross-section of the end portion 26A of the duct) tends to be directed by the diverging air streams towards opposite sides of the splitter member 14.

It should be noted that the concave lower wall 10D of the duct has a relatively large radius of curvature (very much larger than the thickness of the duct, i.e. the distance between walls 10C and 10D). Thus, although the centrifugal force is sufficient to urge the tobacco against the wall 10D and to spread it when the tobacco is free to spread, the centrifugal force is not so high as to cause excessive interaction between the particles of tobacco such as could interfere with the splitting of the stream of particles by the splitter member or members and possibly result in degradation of the tobacco.

As shown in FIG. 3, the space between the diverging arms of the splitter member 14 may be filled in to leave a concave hollow surface 14B of which the depth increases progressively towards the downstream end of the splitter member. The other splitter members may be similarly constructed.

The velocity at which the tobacco enters the duct 10 in FIGS. 1 and 2 may be set at the optimum value by use of the feed device described in our Patent Application No. 8038665 (British).

FIG. 5 shows a part of a cigarette making machine including a tobacco supply duct 110 which may be substantially like the duct 10 in FIG. 1 and includes one or more splitter members 120.

The machine includes an air separator 122 which does not have a cylindrical casing as in FIG. 1, apart from a curved wall 122A. Instead, a louvre 122C forms an inner wall through which air is extracted via a duct 122D.

On leaving the outlet 122E of the air separator, the tobacco enters a rotary seal 170. This seal is basically like the seal 70 shown in FIG. 1 and includes a rotary member 171 rotating in a cylindrical housing 172 formed with an inlet opening 172A and an outlet 172B. The rotary member itself comprises a centre body 171A having four circumferentially spaced projections in the form of vanes 171B. The rotary member rotates in counterclockwise direction.

This rotary seal differs from that shown in FIG. 1 in that it has provision for preventing tobacco being trapped between the outer extremity of each vane 171B and the part of the surrounding casing immediately downstream of the inlet opening 172A in relation to the direction of movement of the vanes. For that purpose, a part 172C of the casing immediately downstream of the inlet 172A is set at a larger radius so as to provide a slight clearance between it and the extremity of each vane 171B passing by; the clearance is shown slightly exaggerated for the purpose of illustration. Furthermore, a narrow slot 172D in the wall of the casing allows air to enter the space 173 (containing tobacco which is not shown) just as a vane is passing the portion 172C of the housing; thus a stream of air from the space 173 flows through the gap formed between each vane and the portion 172C of the housing, and tends to blow back towards the inlet 172A any tobacco which might otherwise be trapped between the vane and the casing.

Except in the region of the portion 172C of the casing, there is only a small running clearance between the casing and the vanes 171B. Thus the rotary seal prevents any significant flow of air from the atmosphere into the air separator 122.

Tobacco discharged through the outlet 172B from the rotary seal enters a channel 180 formed by parallel or slightly diverging walls 180A and 180B. A column of tobacco 181 builds up in the channel 810 and is fed continuously from the lower end of the channel by a knurled roller 182 towards a spiked roller 184. A refuser roller 186 tends to spread out any lumps in the tobacco which protrude from the spikes of the roller 184 (or to brush back any such lumps). Thus a substantially metered carpet of tobacco is carried forward by the roller 184, and this tobacco is removed from the roller 84 by a picker roller 188 which helps to project the tobacco downwards onto a ramp 190. An extension of the ramp 190 beyond a rotary magnet 191 forms the lower wall of a channel 192 in which a thinner column of tobacco builds up. A more precisely metered carpet of tobacco is fed from the lower end of the channel 192 by a spiked roller 194, and a further picker roller 196 removes the tobacco from the roller 194 to spread it along a carpet-carrying conveyor band (not shown) moving preferably to the left. At the end of the conveyor band, the tobacco may be showered towards a transversely moving suction conveyor in any conventional manner. The magnet 191 projects through a break in the wall 190 and is arranged to carry away any ferrous foreign bodies, which are removed from the magnet by a scraper 191A so as to drop into a collecting tray 191B.

A further spiked roller 200 is mounted for rotation with the tips of its spikes spaced from the ramp 190. Relatively loose tobacco can slide down the ramp, past the roller 200, whereas any significant lumps of tobacco tend to be picked up by the roller 200. The lumps are then removed from the roller 200 by the spikes on the roller 184, which intermesh with those of the roller 200 and are arranged to move at a higher peripheral speed (e.g. approximately 50% higher). This tends to open up the lumps. Some loose particles of tobacco may drop onto the roller 194 while the remainder transfers to the roller 184 and continues in a relatively loose condition on the drum 184 until being again removed by the picker roller 188. This tends to open up the lumps so that they can pass safely into the channel 192.

Although not clearly shown in FIG. 5, it is intended that the tips of the spikes on the roller 200 should move along a circular path which, in the region closest to the ramp 190, is spaced from the ramp by a distance smaller than the thickness of the channel, so that any lumps of tobacco which might jam in the channel are likely to be picked up by the roller 200.

The height of the tobacco column in the channel 192 is detected by a photoelectric or other detector 198 which controls the speed of the roller 182 in order to maintain the tobacco height substantially constant. The roller 184 rotates at a constant speed and has a tobacco-carrying capacity well in excess of the average requirement, so that it can feed towards the column 190 as much tobacco as is delivered to it by the roller 182. Thus, speed control is only needed for the relatively low-inertia roller 182, rather than for a much higher-inertia conveyor as in some prior proposals. This hopper construction is useful in its own right, particularly in combination with a substantially continuous feed system, since such feed systems tend to minimise tangling up of the tobacco.

A portion 190A of the ramp 190 is formed as a pivoted flap controlled by a pneumatic actuator 190B. The flap can be swung inwards (to the position shown in dotted outline) by extending the actuator so as to deflect all the tobacco onto the roller 200; this may be arranged to happen automatically, for example, as soon as the cigarette making machine is switched off.

The spiked roller 184 may consist of a smooth-surfaced aluminimum roller around which is wrapped a sheet of stainless steel (e.g. 0.8 mm thick) with portions 184 partially sheared out (as shown in FIG. 6) and then bent outwards to form the desired spikes.

Instead of being knurled, the roller 182 may be grit-coated or shot-blasted.

Delivery of tobacco into the channel 180 is controlled by a tobacco height detector 202. Whenever the height of the tobacco column 181 approaches the top of the channel 180, the detector 202 causes the delivery rate of tobacco into the duct 110 to be automatically reduced or possibly to be stopped temporarily.

If delivery of tobacco into the duct 110 is temporarily discontinued when the channel 180 is nearly full, discard tobacco may continue to be returned to the duct in the manner shown in FIGS. 1 to 4 (via duct 26). In order to avoid the formation of a layer of pure discard tobacco in the channel 180, the following provision may be made if desired. At the upper end of the channel 180, part of one of the walls of the channel may comprise a pivoted flap which pivots inwards to deflect the pure discard tobacco to a position adjacent to the other wall of the channel so that it occupies only part of the space between the two walls, the remainder of which will therefore be occupied by a mixture of fresh tobacco and discard tobacco when the delivery of fresh tobacco is resumed. Timing of the movement of the flap may be achieved automatically with the aid of a pick-off responding to rotation of the rotary seal.

FIGS. 7 and 8 show a different form of rotary seal which also serves as an air separator and which may be used in place of the air separator and rotary seal shown in FIG. 5.

Tobacco is delivered pneumatically by a duct 300 including one or more splitter members 302 as previously described. The duct leads into an expansion chamber 304 formed by diverging walls 304A and 304B in which the air slows down while tobacco tends to move approximately along the path 306 (while continuing to spread) and then slides along the wall 304A towards the rotary seal 308.

Within the rotary seal there is a rotating porous drum 310 formed by a thick perforated plate (approximately 40% open area) which is covered by a fine wire gauze 312 to prevent passage through the drum of even relatively small particles of tobacco.

The drum 310 is supported and driven from one end (the left-hand end of FIG. 8), as described below; air is extracted at the other end through a hollow stator 314 of which the internal cross-section increases progressively towards the right-hand end of FIG. 7, as shown by successive shading line 316 in FIG. 6. This helps to avoid dust depositing in the stator.

A fixed cylindrical casing 318 around and coaxial with the drum 310 has an outlet 320 (FIG. 7) leading to a channel formed by parallel walls 322 and 324 which may correspond to the walls 180A and 180B in FIG. 5. Between the drum and the housing, there are six radially projecting members which rotate with the drum, each comprising a roller 326 which forms the outer extremity of the projecting member, and a vane 328 which is fixed with respect to the drum.

Most of the tobacco reaches the stationary housing 318 at a point 330 where pinching between the housing and any passing roller 326 is avoided by means of counter-clockwise rotation of the roller. For that purpose, each of the rollers, while passing through that region, is rotated at high speed by means of a stationary driving surface 332 engaging a small-diameter end portion 326A of the corresponding roller. Furthermore, the housing 318 is internally relieved between the point 330 and a point 334, allowing time for the roller 326 to throw back any tobacco which may tend to be trapped between the roller and the housing. Downstream of the position 334, each roller is no longer positively driven by the driving surface 332, but possibly rolls along the inner surface of the housing until position 336.

Shortly after passing the position 336 on the housing, each roller reaches a second driving member 340 which engages the driving portion of the roller to rotate the roller at high speed in a clockwise direction. This helps to throw tobacco downwards into the channel formed by the walls 322 and 324. Meanwhile, the interior of the drum in that region is opened to atmosphere or subjected to slight above-atmospheric pressure via a groove 342 extending along the stator 314, thus helping to remove tobacco from the drum.

Each of the roller driving members 332 and 340 may be spring mounted so as to be resiliently urged towards the roller or rollers to facilitate the drive.

As already mentioned, the drum 310 is carried in cantilever fashion from one end (the left-hand end in FIG. 8) by a bearing 350. Air is sucked out from the opposite end by a suction fan (not shown).

Each of the rollers 326 is rotatably mounted at both ends in bearings 352 carried by flanges 354 and 356 on the respective ends of the drum.

FIG. 9 shows a rotary seal having substantially the same fixed parts as are shown in FIG. 7, but with a modified rotary member embodying a concept similar to that shown in FIG. 5. As in FIG. 7, tobacco leaving one or more splitter members 402 moves along a path 406 before reaching a concave wall 404A. It should be noted that the wall 404A (and similarly the wall 304A in FIG. 7) directs the tobacco approximately tangentially into the cylindrical housing 418, but with a slight inward inclination.

A porous rotary drum 410, possibly covered by a wire gauze 412, rotates around a fixed stator 414 which may be similar to the stator 314 in FIG. 7. A number of radial vanes 428 on the drum 410 prevent any significant flow of air from the tobacco outlet 420 to the chamber 404 through which air and tobacco enter the rotary seal. The tips of the vanes have a small running clearance with respect to the inner cylindrical surface 418A of the housing 418, except where that surface is relieved as shown in FIG. 9.

The inner surface of the housing is relieved notably between points 430 and 434 (i.e. has a larger internal radius) to provide clearance in that region with respect to the tips of the vanes 428. Furthermore, as in FIG. 5, there is an air inlet 418B whereby air is sucked in from the atmosphere owing to the suction pressure existing in the chamber 404, thus producing an air flow (indicated generally by an arrow 480) across the tip of each vane 428 as it passes between the points 430 and 434. This helps to ensure that tobacco is not crushed between the tip of any vane and the close-fitting part of the housing surface 418A downstream of the point 434, since any tobacco which might tend to catch on the tip of a vane as it approaches the point 430 will tend to be blown off by the air stream across the vane.

As in FIG. 7, the stator 414 may have an axial groove 442 which is open to atmosphere or supplied with slightly above-atmospheric pressure to blow tobacco or tobacco dust radially off the drum 410 in that region.

FIG. 10 illustrates a possible modification of the arrangement of splitter members shown in FIG. 2. In particular, it shows a duct 510 which is generally similar to the duct 10 shown in FIG. 2. However, splitter members 514, 518 and 520 in this example are generally diamond-shaped. The first splitter 514, for example, may comprise an insert of generally constant thickness having diverging walls 514A and 514B for moving apart the two portions of the tobacco stream (not shown), and converging portions 514C and 514D which help to avoid air eddies in the duct. At the leading edge of the splitter member 514 there is a plate member 550 which is pivoted to the splitter member 514 at 552 so that its position can be adjusted slightly in the direction of the arrow 554; thus any tendency for an uneven division of tobacco to occur along opposite sides of the splitter member 514 (e.g. arising from a bend in the ducting upstream of the duct portion 510) can be compensated by adjustment of the member 550 about its pivot 552.

Towards its trailing edge 514E, the splitter member 514 may be chamfered so as to reduce progressively in thickness.

The secondary splitter members 518 and 520 are also diamond-shaped. Their leading and trailing edges may also be chamfered in the manner described with reference to the trailing edge of the splitter member 514.

FIG. 11 shows a different construction in which an air separator 600 is located upstream of a widening duct portion 602 containing one or more splitter members for spreading the tobacco. The duct portion 602 may be generally similar to the duct portion 510 shown in FIG. 10. Specifically, it is shown with a first splitter member 604 including an adjustable plate 606 like the plate 550 in FIG. 10. This first splitter member, and also two secondary splitter members 608 are mounted on a concave wall 602A, and in this example it is also made clear that the duct portion 602 is preceded by a duct portion 610 which is curved in the same sense as the duct portion 602 and in the opposite sense to a preceding duct portion 612, so that the tobacco is caused to move along the path 614 which brings it into contact with the lower wall of the duct at a position which is upstream of the splitter members and is furthermore upstream of the air separator 600. The air separator 600 comprises a portion 600A of the duct which has a perforated upper section so that air can be drawn out of the duct via a housing 600B which surrounds the duct portion 600A and has an outlet 600C which is to be connected to a suction fan (not shown). It will be understood that tobacco slides along the lower non-perforated section of the duct portion 600A. After passing through the duct portion 600A, the tobacco continues under its own momentum through the duct portion 602 in which it is spread horizontally by the splitter members 604 and 608 as previously described. The downstream end 614 of the duct leads into a rotary or other seal, for example as shown in the other Figures of the accompanying drawings.

In FIG. 2 the included angle between the strips forming the splitter member 14 (as also between walls 514A and 514B in FIG. 10) may be somewhat smaller, e.g. about 20°. The angle between the strips forming each secondary splitter 18 and 20 (and correspondingly also in FIG. 10) may be controlled so as to alter cyclically to ensure that the tobacco is evenly spread.

By way of example, the following speeds and dimensions may apply to FIG. 5. The roller 182 has an average peripheral speed of approximately 3 cm/second; the drums 184 and 200 have peripheral speeds of approximately 84 cm/second and 60 cm/second respectively; the carpet thickness in the channel 180 is approximately 65 mm; and the carpet thickness in the channel 192 is approximately 18–20 mm.

I claim:

1. A rotary seal for use in apparatus for continuously feeding tobacco to a cigarette making machine, comprising a rotary member surrounded by a coaxial cylindrical housing having spaced openings for respectively receiving and discharging tobacco, the rotary member comprising a center body carrying a number of circumferentially spaced projections extending to the housing and forming air seals while conveying tobacco from an inlet opening to an outlet opening of the housing, and including moving means for acting on said tobacco to cause movement of tobacco relative to the housing and relative to a main part of each projection so as to move back toward the housing inlet opening (or in the opposite direction) any tobacco which might otherwise be trapped between each projection and the housing as the projection moves past the inlet opening.

2. A rotary seal for use in apparatus for continuously feeding tobacco to a cigarette making machine, comprising a rotary member surrounded by a coaxial cylindrical housing having spaced openings for respectively receiving and discharging tobacco, the rotary member comprising a center body carrying a number of circumferentially spaced projections extending to the housing and forming air seals while conveying tobacco from an inlet opening to an outlet opening of the housing, and including moving means for acting on said tobacco to cause movement of tobacco relative to the housing and relative to a main part of each projection so as to move back toward the housing inlet opening (or in the opposite direction) any tobacco which might otherwise be trapped between each projection and the housing as the projection moves past the inlet opening, in which the means for directing tobacco comprises a roller forming the extremity of each projection, and means for rotating the roller.

3. A rotary seal for use in apparatus for continuously feeding tobacco to a cigarette making machine, comprising a rotary member surrounded by a coaxial cylindrical housing having spaced openings for respectively receiving and discharging tobacco, the rotary member comprising a center body carrying a number of circumferentially spaced projections extending to the housing and forming air seals while conveying tobacco from an inlet opening to an outlet opening of the housing, and including moving means for acting on said tobacco to cause movement of tobacco relative to the housing and relative to a main part of each projection so as to move back toward the housing inlet opening (or in the opposite direction) any tobacco which might otherwise be trapped between each projection and the housing as the projection moves past the inlet opening, in which the means for directing tobacco comprises an air inlet in the housing arranged to produce a flow of air across the extremity of each projection as it moves away from the inlet opening.

4. A rotary seal according to claim 3 in which the inner surface of the housing adjacent to the inlet opening is relieved to provide additional clearance in that area between the housing and the projections for the passage of air across the extremities of successive projections.

5. A rotary seal according to claim 3 in which the air inlet is a vent to atmosphere, whereby sub-atmospheric pressure in the inlet opening will induce air flow inwards through the air inlet and across the projections.

6. A hopper for a cigarette making machine for use with a continuous tobacco feed, comprising a first pair of substantially parallel downwardly-extending walls defining a channel for receipt through the upper end thereof of a continuous supply of tobacco forming a relatively thick carpet of tobacco; a roller at the lower end of the channel arranged to convey the carpet of tobacco from the channel at a variable speed towards a spiked conveyor of which the spikes have a tobacco-carrying capacity greater than the tobacco feed rate existing when the roller rotates at its maximum speed and a second pair of substantially parallel downwardly-extending walls for receiving therebetween the tobacco fed by the spiked conveyor and for forming a relatively thin carpet of tobacco.

7. A hopper according to claim 6, in which the said spiked conveyor is adapted to convey the tobacco along a predetermined path at the end of which the tobacco is removed from said spiked conveyor by a picker roller to form said relatively thin carpet of tobacco.

8. A hopper for use with a continuous tobacco feed, comprising a first pair of substantially parallel downwardly-extending walls defining a channel for receipt through the upper end thereof of a continuous supply of tobacco forming a relatively thick carpet of tobacco; a roller at the lower end of the channel arranged to convey the carpet of tobacco from the channel at a variable speed towards a spiked conveyor of which the spikes have a tobacco-carrying capacity greater than the tobacco feed rate existing when the roller rotates at its maximum speed and a second pair of substantially parallel downwardly-extending walls for receiving therebetween the tobacco fed by the spiked conveyor and for forming a relatively thin carpet of tobacco, in which the spiked conveyor comprises a spiked drum which rotates in a direction such as to carry tobacco upwards from the relatively thick carpet conveyed to it by the roller, a spiked roller which is arranged to remove the tobacco from the spiked drum and to cause the tobacco to move generally downwards, and a pair of substantially parallel downwardly-extending walls defining a second channel which is arranged to receive tobacco from the spiked drum, the distance between the said walls of the second channel being small enough to form said relatively thin carpet of tobacco in the second channel.

9. A hopper according to claim 8, including a ramp along which the tobacco is arranged to slide on its way to the second channel, and a further spiked drum which is arranged to pick up lumps of tobacco from the ramp while permitting loose particles of tobacco to slide past it on the ramp.

10. A hopper according to claim 9 in which the spikes of the further spiked drum are arranged to intermesh with the spikes of the first spiked drum, the arrangement being such that the spikes of the first spiked drum move at a higher speed than those of the second spiked drum and are arranged to remove the lumps of tobacco from the second spiked drum, whereby the lumps will tend to be opened up on again being subjected to the action of the spiked roller which removes tobacco from the first spiked drum.

11. A hopper for a cigarette making machine for use with a continuous tobacco feed, comprising substantially parallel downwardly-extending walls defining a channel for receipt through the upper end thereof of a continuous supply of tobacco forming a relatively thick carpet of tobacco; a roller at the lower end of the channel arranged to convey the carpet of tobacco from the channel at a variable speed towards a spiked conveyor of which the spikes have a tobacco-carrying capacity greater than the tobacco feed rate existing when the roller rotates at its maximum speed; and means for receiving the tobacco fed by the spiked conveyor and for forming a relatively thin carpet of tobacco, said spiked conveyor being adapted to convey the tobacco along a predetermined path at the end of which the tobacco is removed from said spiked conveyor by a picker roller to form said relatively thin carpet of tobacco.

* * * * *